US005433521A

United States Patent [19]

Inoue et al.

[11] Patent Number: 5,433,521

[45] Date of Patent: Jul. 18, 1995

[54] BATCHER PLANT FOR PRODUCING READY-MIXED CONCRETE

[75] Inventors: Takao Inoue, Tokyo; Makoto Saito, Kawasaki, both of Japan

[73] Assignee: Kajima Corporation, Tokyo, Japan

[21] Appl. No.: 247,234

[22] Filed: May 23, 1994

[30] Foreign Application Priority Data

May 21, 1993 [JP] Japan ..... 5-119972

[51] Int. Cl.[6] ..... B28C 7/06; B28C 7/12

[52] U.S. Cl. ..... 366/16; 366/26; 366/34

[58] Field of Search ..... 366/16, 17, 18, 19, 366/20, 21, 27, 28, 30, 26, 33, 34, 35, 37, 40, 41, 42, 8, 14, 141, 184, 177, 181

[56] References Cited

U.S. PATENT DOCUMENTS

| | | | |
|---|---|---|---|
| 3,343,688 | 9/1967 | Ross | 366/18 |
| 3,415,498 | 12/1968 | Zaccaron | 366/37 |
| 3,812,889 | 5/1974 | Strehlow . | |
| 3,817,497 | 6/1974 | Waltman | 366/18 |
| 4,204,773 | 5/1980 | Bates | 366/18 |
| 5,121,989 | 6/1992 | Horton | 366/26 |

FOREIGN PATENT DOCUMENTS

| | | |
|---|---|---|
| 552050 | 9/1930 | Germany . |
| 1584624 | 4/1970 | Germany . |
| 2249150 | 4/1974 | Germany . |
| 2414074 | 9/1976 | Germany . |

*Primary Examiner*—Robert W. Jenkins

*Attorney, Agent, or Firm*—Wenderoth, Lind & Ponack

[57] ABSTRACT

A batcher plant for producing ready-mixed concrete is miniaturized by disposing, side by side on a trestle, a cement-paste making unit with cement measuring means and a stationary cement-paste mixer and an aggregate processing unit with fine and coarse aggregate receptacles. Cement paste prepared by the cement-paste making unit is admitted from the cement-paste mixer into a mixing drum of a truck mixer independently of admission of mixed fine and coarse aggregates quantitatively measured by the aggregate receptacles, so that the loading of concrete materials in the truck mixer can be effectively carried out without loss of efficiency caused by waiting time.

2 Claims, 5 Drawing Sheets

BATCHER PLANT FOR PRODUCING READY-MIXED CONCRETE

BACKGROUND OF THE INVENTION

FIELD OF THE INVENTION

This invention relates to a batcher plant for producing ready-mixed concrete, which is made compact by rationally arranging an aggregate processing unit and a cement-paste making unit, and is capable of effectively mixing fine and coarse aggregate, cement and water.

DESCRIPTION OF THE PRIOR ART

In general, a conventional batcher plant for producing ready-mixed concrete comprises a batching system 1 in which a fine aggregate receptacle 2 with fine aggregate measuring means 2*a*, a coarse aggregate receptacle 3 with coarse aggregate measuring means 3*a*, cement measuring means 4, and a stationary mixer 5 are vertically disposed as illustrated in FIGS. 1A and 1B. The batching system 1 is fixed on a trestle 6. Fine aggregate such as sand and coarse aggregate such as 9ravel and crushed stone are conveyed to the fine and coarse aggregate receptacles 2 and 3 by means of aggregate transport conveyors 7 supported by support columns 7*a*. To the cement measuring means 4, cement and water are forcibly fed from a tank lorry 8 by means of a pump 8*a*.

The predetermined amount of cement quantitatively measured by the cement measuring means 4 is introduced into the stationary mixer 5 together with the quantitative water and the fine and coarse aggregates contained in the receptacles 2 and 3 which are quantitatively measured by the respective measuring means 2*a* and 3*a*. These raw materials are kneaded in the mixer 5 to concoct ready-mixed concrete. The ready-mixed concrete thus obtained is admitted into the mixing drum of a truck mixer through a hopper 9.

The conventional batcher plant as described above is massive and stationarily placed in an industrial establishment or other possible facility. Furthermore, this batcher plant has suffered an economic disadvantage in that the production capacity to produce ready-mixed concrete of this conventional batcher plant is rather small relative to the scale of the overall system.

For instance, the conventional batcher plant with a quantitative mixer having the declared efficiency of $1.75m^3$/batch comes up to about 11 tons in total weight and over 20 meters in height. On the other hand, in general, a truck mixer commonly used generally is $4.5m^3$in capacity to transport ready-mixed concrete, which is about three times as great as the batching capacity of the conventional batcher plant 8 as noted above. Thus, the truck mixer must wastefully wait for a long time to fill the mixing drum thereof with ready-mixed concrete produced by the batching system.

The aggregate transport conveyor for delivering aggregate to the fine and coarse aggregate receptacles placed at an elevated spot is markedly elongated in a general U-shape as illustrated, and therefore, calls for a vast site or area occupied by the plant.

There has been known another batcher plant having a stationary mixing system constructed by vertically arranging a mortar mixer and a cement mixer. In this prior art batcher plant, the mortar mixer and cement mixer are separated from each other for the purpose of carrying out individually the mixings for mortar and cement to contemplate shortening the time required to produce ready-mixed concrete. However, this batcher plant entailed a disadvantage in that it has been as inefficient as ever and is not an economically productive system.

Incidentally, while it is known that dispersibility of cement particles in ready-mixed concrete influences the strength of hardened concrete, it requires too much energy to uniformly disperse the cement particles in the ready-mixed concrete. That is, since adhesion of particles including water or other liquid (e.g. Van Der Waals' forces or surface tension) is in inverse proportion to the diameter of the particle, the separating and dispersing of fine particles such as cement particles necessitates hugely large mixing energy equal to several hundred times the energy required for breaking off the bonding of relatively large particles such as sand aggregate.

Therefore, the dispersibility of the cement particles in the ready-mixed concrete is possibly improved by independently carrying out the mixing of cement and water so as to concentrate mixing energy on cement paste resultantly prepared in the mixer. In light of this phenomenon, the inventors of this invention have formerly contrived a highly functional cement-paste mixer capable of uniformly dispersing cement particles to a high degree and substantiated the supposition described above.

Furthermore, since the mixing of cement paste prepared in advance by use of the highly functional mixer does not require too much mixing energy according to the considerations of the inventors of the present invention, pre-mixing of cement paste may be possibly achieved by use of the mixing drum of a truck mixer. In the case of mixing the cement and aggregate in the mixing drum, the aggregate and cement paste can be admitted into the mixing drum from a comparatively low position. It turns out that the batching plant facilities can be considerably reduced in scale. In addition, as the mixing ratio of cement paste to aggregate in the mixing process is small, the production capacity can be expected to be substantially elevated. Thus, use of the highly functional mixer contrived by the inventors of this invention is advantageous in producing ready-mixed concrete.

OBJECT OF THE INVENTION

An object of the present invention is to provide a batcher plant for producing ready-mixed concrete with high efficiency, that is capable of notably reducing the scale of an overall batching system including cement and aggregate mixing facilities, that can be constructed at a low cost, and that efficiently improves the ability to produce the ready-mixed concrete.

SUMMARY OF THE INVENTION

To attain the object described above according to the present invention, there is provided a batcher plant for producing ready-mixed concrete, which comprises a cement-paste making unit including cement measuring means and a stationary cement-paste mixer for making cement paste of cement and water and a paste hopper, and an aggregate processing unit including a fine aggregate receptacle, a coarse aggregate receptacle and an aggregate hopper. The cement paste making unit and the aggregate processing unit are separately disposed side by side.

Fine aggregate and coarse aggregate are respectively conveyed to the fine and coarse aggregate receptacles by means of at least one aggregate transport conveyor, and then, quantitatively measured and introduced into the aggregate hopper.

The quantitative amounts of fine and coarse aggregates are jumbled together in the hopper and admitted into a mixing drum of a truck mixer.

Cement fed into and quantitatively measured by the cement measuring means is introduced into the stationary mixer and kneaded with water therein to concoct cement paste. The cement paste thus obtained is admitted into the mixing drum of the truck mixer to be mixed with the aggregate in the mixing drum.

Since the aggregate processing unit and the cement-paste making unit are separately disposed adjacent to each other, the raw materials such as aggregate and cement paste are efficiently admitted into the movable mixing drum from a low level position in sequence. Furthermore, the batcher plant can be remarkably reduced in its overall height and weight, while shortening the total length of the aggregate transport conveyor and reducing the area occupied by the batcher plant. Thus, miniaturization of the plant can be materialized.

Other and further objects of this invention will become obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWINGS

Other objects and features of the present invention will be explained in detail hereinafter with reference to the accompanying drawings, wherein.

DESCRIPTION OF THE PREFERRED EMBODIMENTS

Figure 1A:
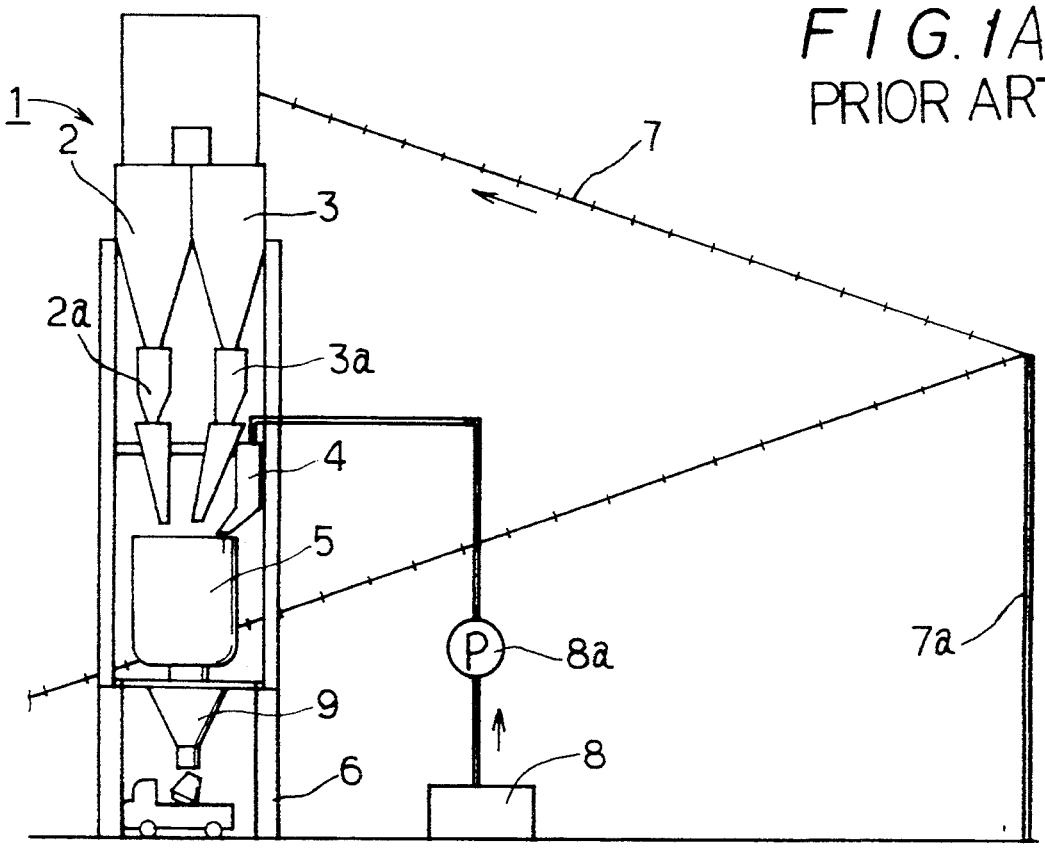
FIG. 1A PRIOR ART
FIG. 1A is a schematic side view showing a prior art batcher plant.
Figure 1B:
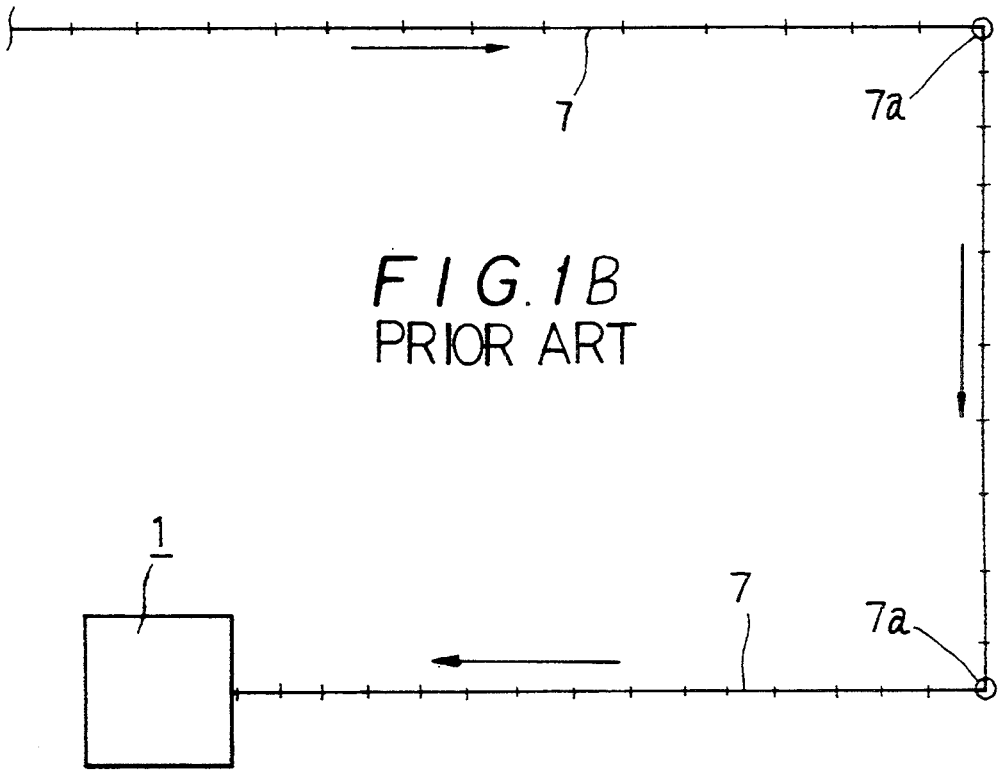
FIG. 1B PRIOR ART
FIG. 1B is a schematic plan view of FIG. 1A.
Figure 2:
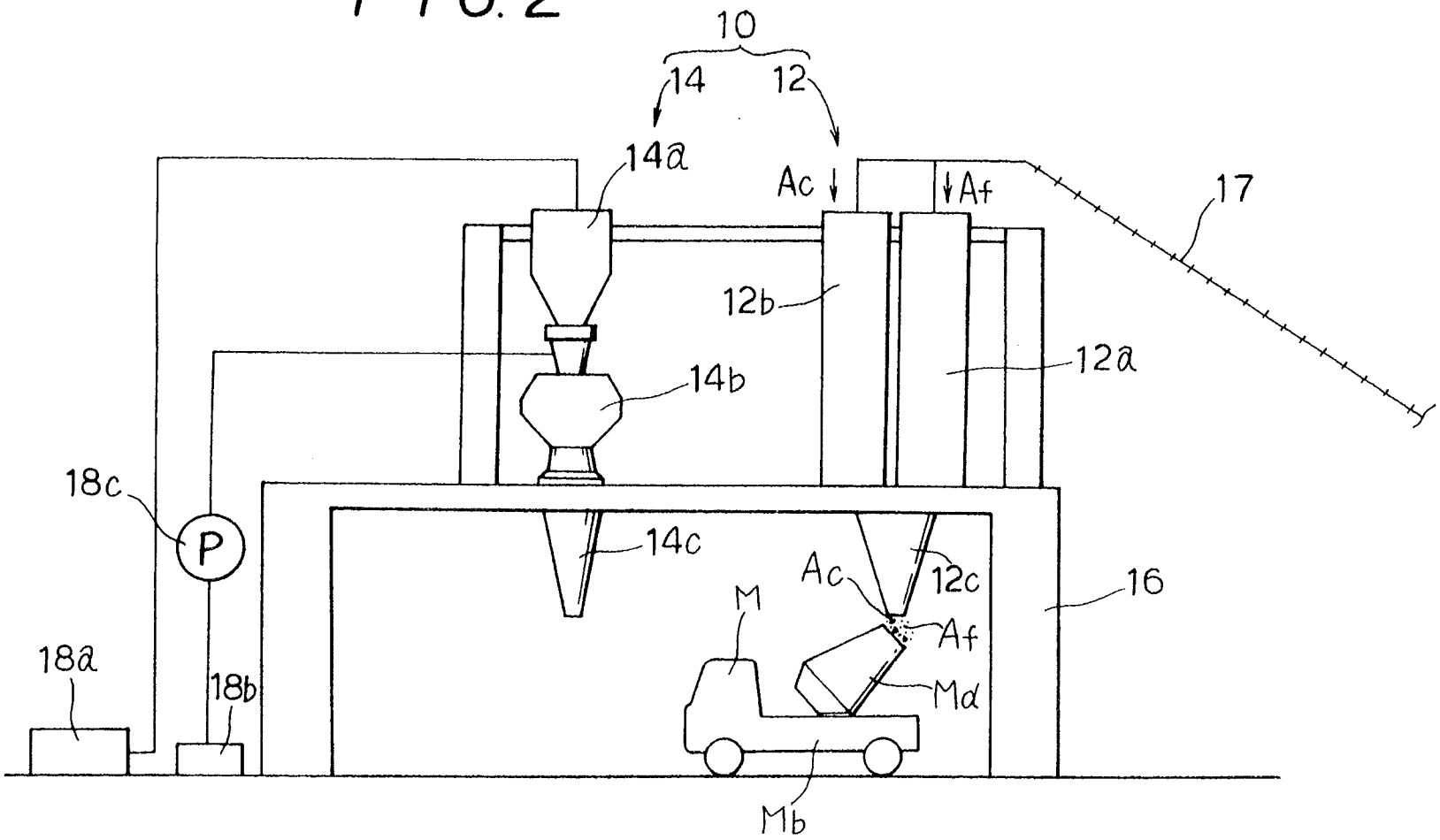
FIG. 2 is a schematic side view showing one embodiment of a ready-mixed concrete batcher plant according to the present invention, in the state of admitting aggregate into the mixing drum of a truck mixer.
Figure 3:
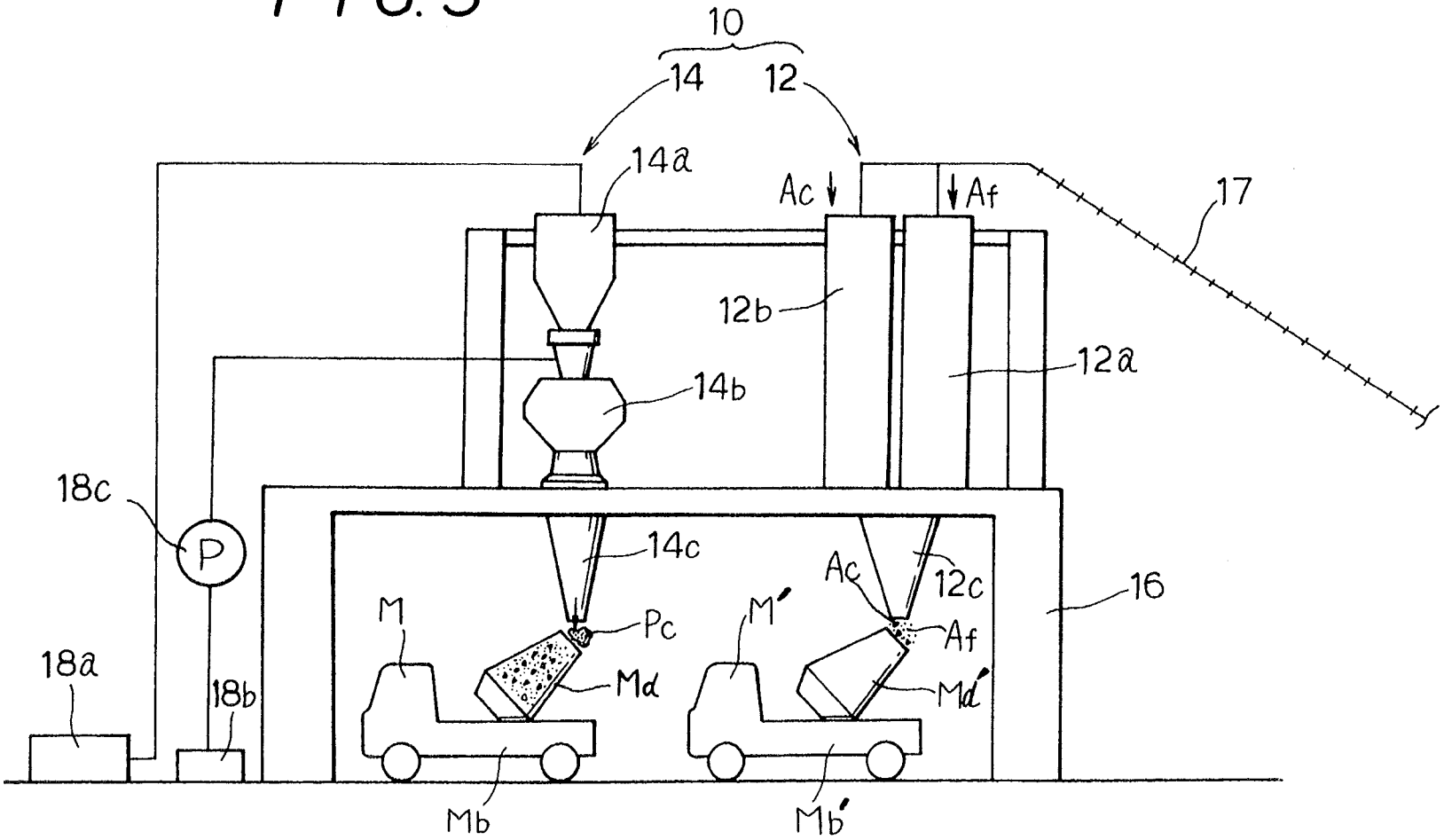
FIG. 3 is a schematic side view of the batcher plant of FIG. 2, in the state of admitting cement paste into the mixing drum of a truck mixer.

FIGS. 2 and 3 depict one embodiment of the ready-mixed concrete batcher plant according to the present invention. With reference to these drawings, a batching system 10 comprises an aggregate processing unit 12 and a cement-paste making unit 14. The batching system 10 is installed on a trestle 16 so as to allow a truck mixer M to go in and out under the batching system 10, but placed at a low altitude. On the trestle 16, the aggregate processing unit 12 and the cement-past making unit 14 are placed side by side as illustrated in the drawings.

The aggregate processing unit 12 includes a fine aggregate receptacle **12*a* for containing fine aggregate such as sand, a coarse aggregate receptacle 12*b* for containing coarse aggregate such as gravel and crushed stone, an aggregate hopper 12*c* for having fine and coarse aggregates received from the aggregate receptacles 12*a* and 12*b* and admitted into the mixing drum Md of the truck mixer M. The receptacles 12*a* and 12*b* each have a function of quantitatively measuring the fine and coarse aggregates and respectively feeding the quantitative amounts of the fine and coarse aggregates to the aggregate hopper 12*c*. The fine and coarse aggregates are conveyed to the fine and coarse aggregate receptacles 12*a* and 12*b* by means of one or more aggregate transport conveyors 17**.

The cement-paste making unit 14 disposed adjacent to the aggregate processing unit 12 on the trestle 16 comprises cement measuring means **14*a*, a stationary cement-paste mixer 14*b*, and a paste hopper 14*c*. These components are arranged vertically in such a State that measuring means 14*a* is placed on the stationary mixer 14*b*, and the stationary mixer 14*b* is placed on the paste hopper 14*c*** as illustrated.

Cement is sent to the measuring means **14*a* from a cement lorry 18*a* and quantitatively measured by the measuring means 14*a*. The quantitative amount of cement thus measured is fed to the mixer 14*b***.

Water is supplied to the mixer **14*b* from a water source 18*b* by actuating a pump 18*c*. The cement and water supplied to the cement-paste mixer 14*b* are kneaded in the mixer 14*b*** so as to prepare cement paste in which cement particles are dispersed to a high degree.

A process in which ready-mixed concrete is produced in the aforementioned batcher plant will be described hereinafter. First of all, the coarse aggregate Ac and fine aggregate Af contained in the receptacles **12*a* and 12*b* are admitted into mixing drum Md of the truck mixer M through the hopper 12*c*, as illustrated in FIG. 2. At the same time, quantitatively prescribed amounts of cement and water are supplied into the stationary cement-paste mixer 14*b*** to prepare cement paste Pc.

Next, the truck mixer M is moved to a position under the paste hopper **14*c* so that the cement paste Pc prepared in the mixer 14*b* can be admitted into the mixing drum Md of the truck mixer M, as shown in FIG. 3. While loading the preceding truck mixer M with the cement paste Pc, a succeeding truck mixer M' is moved to a position under the aggregate hopper 12*c*** so as to admit the mixed fine and coarse aggregates Af and Ac into a mixing drum Md' of the succeeding truck mixer Md', as shown in FIG. 3.

Figure 4:
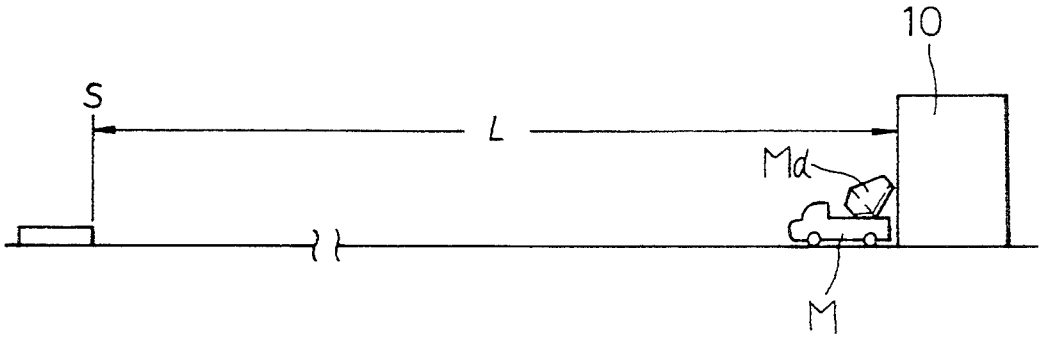
FIG. 4 is a schematic elevation showing the manner in which mixing is performed by the truck mixer.

After loading the truck mixer M with the cement paste Pc, the cement paste Pc and aggregates Af and Ac are thoroughly kneaded in the mixing drum Md, while moving the truck mixer M toward an off-loading site S which is "L" distant from the batching system 10 as shown in FIG. 4.

It is a matter of course that the cement paste Pc may be first admitted into the mixing drum Md, and the fine and coarse aggregates Af and Ac may be admitted into the mixing drum after admission of the cement pasts into the drum, or the cement paste Pc and fine and coarse aggregates Af and Ac may be admitted into the mixing drum Md at a time.

As described above, since the batcher plant according to the invention employs the batching system in which the mixed fine and coarse aggregates and the cement paste are severally admitted into the mixing drum of one truck mixer, these raw materials for ready-mixed concrete can readily be dealt with at a low level position. Therefore, the overall height of the batching system including the measuring means 14*a* and mixer 14*b* can be lowered notably and made compact, and the area occupied by the plant can be remarkably reduced to the fullest possible extent. Incidentally, the aggregate transport conveyor 17 for supplying the fine and coarse aggregates to the aggregate receptacles 12*a* and 12*b* can be shortened in total length. Consequently, the overall height of the batcher plant according to this invention is possibly reduced to about one-third that of the conventional batcher plant, and the overall weight of the plant is also reduced to one-half of that of the conventional plant. Thus, the present invention can materialize miniaturization of the batcher plant.

Moreover, owing to the stationary cement-paste mixer 14*b*, the production capacity to produce cement paste per one batch can be improved. Since the mixing ratio of the cement paste Pc to the aggregate is small so that the waiting time for which the truck mixer is loaded with the cement paste is shortened, the efficiency of producing the ready-mixed concrete can be increased.

Figure 5:
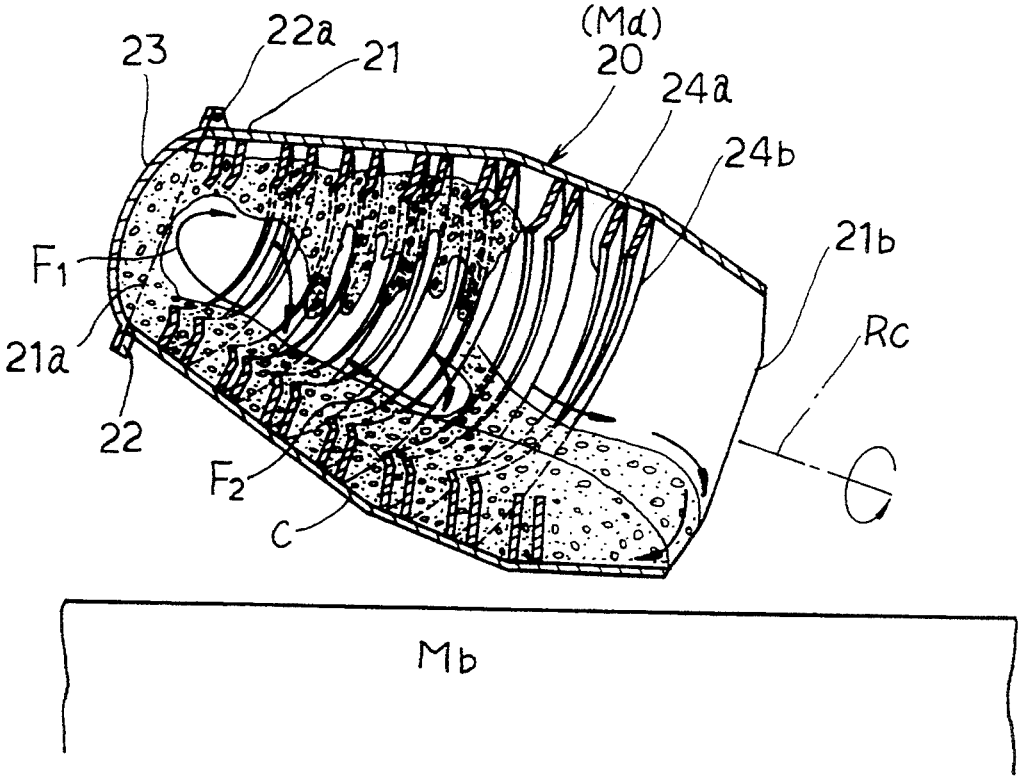
FIG. 5 is a schematic section of a mixing drum used in the invention.
Figure 6:
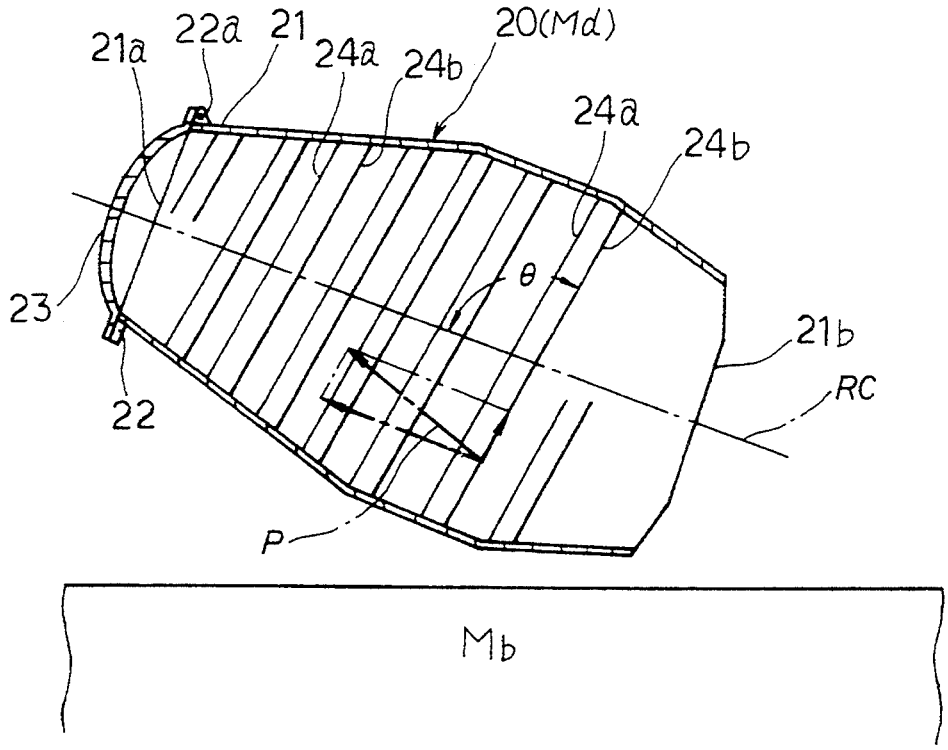
FIG. 6 is a schematic sectional view showing the mixing drum with mixing blades arranged aslant relative to the rotation axis of the drum.
Figure 7:
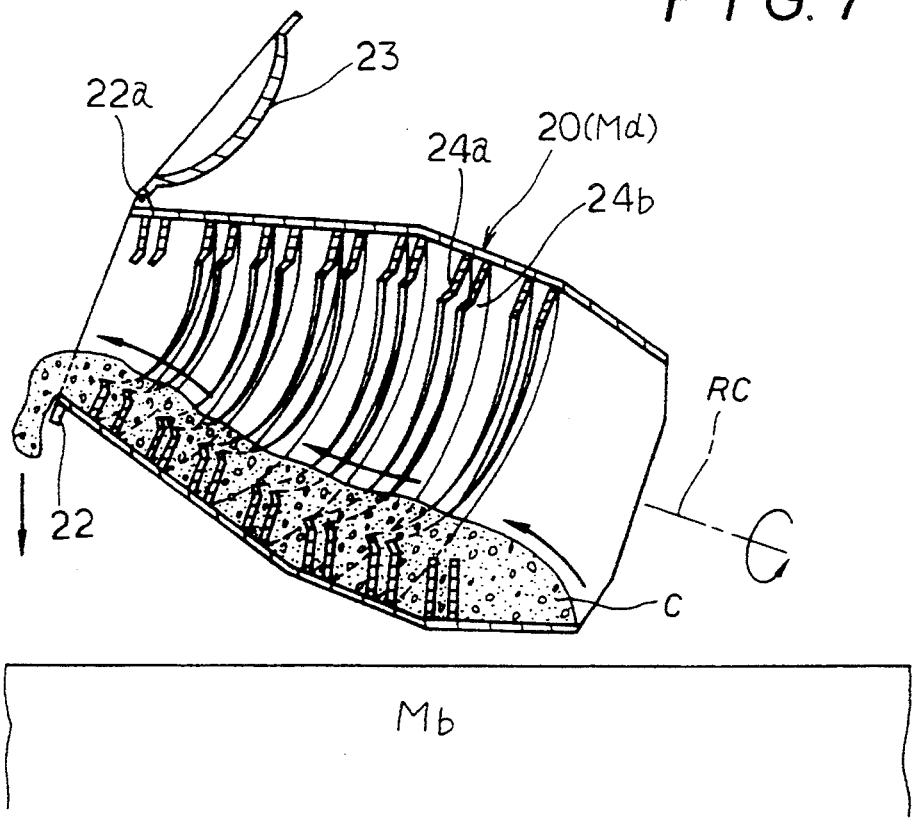
FIG. 7 is a schematic section of the mixing drum, showing the state in which ready-mixed concrete is discharged.

Although the existing truck mixer may be used for the batcher plant of the invention, it is desirable to use a mixing drum proposed by the inventors of this invention in Japanese Patent Application Unexamined Publication No. HEI 5-96527(A), thereby to more increase the bonding strength of cement, and as well, the strength of hardened concrete resulting from the ready-mixed concrete according to the present invention. To be more specific, as illustrated in FIG. 5 through FIG. 7, the truck mixer M is provided on its load carrying platform Mb with a mixing drum 20 (Md) having a rear part 21 with an intake opening 21*a*. The mixing drum 20 is held by a support base (not shown) and driven to rotate about the rotation axis RC in either forward or reverse direction by reversible driving means (not shown). The mixing drum 20 usually positioned aslant with the rear part 21 upturned.

Along the periphery of the intake opening 21*a*, there is formed a flange 22 on which an openable lid 23 is retained through a hinge 22*a*. Inside the mixing drum 20, two spiral mixing blades 24*a* and 24*b* are disposed leaving smaller spaces therebetween in comparison with those in a conventional mixing drum of this type. The spiral mixing blades 24*a* and 24*b* have an angle of rake ($\theta$) nearly perpendicular to the rotation axis RC as shown in FIG. 6. The lid 23 has a curved inner surface so as to permit smooth circulation of concrete materials within the drum. 20 during rotation of the drum.

First, upon opening the lid 23, the mixed aggregate and cement paste are admitted into the mixing drum 20 through the opening 21, and then, the lid 23 is closed. Thereafter, the mixing drum 20 is rotated in the reverse direction so that the concrete material C in the drum moves upward along the spiral mixing blades 24*a* and 24*b* until coming into collision with the lid 23, as indicated by the arrow F2 in FIG. 5. When colliding with the lid 23, the concrete material C turns over upwardly along the curved surface of the lid 23 as indicated by the arrow F1 in FIG. 5. The concrete material C turning over upwardly falls down on the flow of concrete material F2, thus causing recirculation of the concrete material C in the drum 20. As a result, the cement paste and the mixed aggregates are forcibly and thoroughly kneaded to produce fine ready-mixed concrete.

Finally, by opening the lid 23 and reversing the drum 20, ready-mixed concrete resulting from kneading flows out from the intake opening 21*a* along the spiral mixing blades 24*a* and 24*b*.

Even a conventional mixing drum mounted on an ordinary truck mixer may be provided with a lid capable of closing a concrete material intake opening similarly to the present invention as described above so as to possibly heighten the effect of kneading the cement paste and aggregates. However, the mixing blade within the conventional mixing drum is not so aslant as the blades 24*a* and 24*b* in the drum of the present invention, which are inclined at substantial right angles ($\theta$) to the rotation axis of the drum. Therefore, the conventional mixing drum cannot be expected to knead the concrete material with the same high efficiency.

When the mixing is completed (arrival of the mixer at the off-loading site), the rotation of the mixing drum 20 is interrupted temporarily, and then, the lid 23 is opened so that the ready-mixed concrete C can be discharged from the opening 21*a* by turning the mixing drum 20 in the reverse direction and flow out through a chute (not shown).

According to the present invention, the batcher plant for producing ready-mixed concrete can be remarkably miniaturized, and the area occupied by the batcher plant can be reduced to the fullest possible extent, thereby drastically reducing the cost of equipment.

Furthermore, the production capacity to produce ready-mixed concrete per batch is increased so that the productive efficiency of the batcher plant can be improved and the loading of concrete raw materials such as the ready-mixed concrete on a truck mixer can be effectively carried out while lessening the loss of waiting time in loading the truck mixer with the concrete raw materials.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

What is claimed is

1. A batcher plant for producing ready-mixed concrete, said batcher plant comprising:

a trestle, a cement-paste making unit disposed on said trestle and including cement measuring means for quantitatively measuring cement, and a stationary cement-paste mixer for making cement paste of cement and water, and a paste hopper, said cement measuring means, stationary cement-paste mixer and paste hopper being arranged vertically, an aggregate processing unit disposed on said trestle and including a fine aggregate receptacle for containing and quantitatively measuring fine aggregate, a coarse aggregate receptacle for containing and quantitatively measuring coarse aggregate, and an aggregate hopper, said cement paste making unit and said aggregate processing unit being separately disposed adjacent to each other on said trestle, and at least one aggregate transport conveyor for conveying the fine aggregate and coarse aggregate to said fine and coarse aggregate receptacles.

2. A batcher plant for producing ready-mixed concrete according to claim 1, wherein said cement measuring means is supplied with cement from a cement lorry and discharges the cement upon quantitative measurement of the cement, and said cement-paste mixer is supplied with water from a water source by means of a pump, so that the cement and water are kneaded to prepare cement paste in which cement particles are uniformly dispersed.

* * * * *